US006923008B2

(12) United States Patent
Brook et al.

(10) Patent No.: US 6,923,008 B2
(45) Date of Patent: Aug. 2, 2005

(54) METHOD FOR TRANSFERRING CRYOGENIC LIQUIDS AND ASSOCIATED CRYOGENIC FILL NOZZLE INSULATING BOOT

(75) Inventors: Thomas Currie Brook, Shawnigan Lake (CA); Samuel Douglas Chambers, Vancouver (CA)

(73) Assignees: Westpoint Research Inc., Vancouver (CA); Cummins Westport Inc., Vancouver (CA)

( * ) Notice: Subject to any disclaimer, the term of this patent is extended or adjusted under 35 U.S.C. 154(b) by 0 days.

(21) Appl. No.: 10/404,276

(22) Filed: Apr. 1, 2003

(65) Prior Publication Data

US 2004/0016240 A1 Jan. 29, 2004

(30) Foreign Application Priority Data

Apr. 2, 2002 (CA) ..... 2376384

(51) Int. Cl.[7] ..... F17C 13/00; F17C 7/02
(52) U.S. Cl. ..... 62/50.7; 62/50.1
(58) Field of Search ..... 62/45.1, 48.1, 62/50.1, 52.1, 50.7

(56) References Cited

U.S. PATENT DOCUMENTS 3,726,547 A * 4/1973 Cox, Jr. ..... 285/149.1
4,931,326 A * 6/1990 Weil ..... 428/35.8
5,301,723 A 4/1994 Goode ..... 141/82
5,589,020 A 12/1996 Varghese ..... 156/185
5,845,911 A * 12/1998 Gimino ..... 277/636
6,430,744 B1 * 8/2002 Redman et al. ..... 2/16

* cited by examiner

*Primary Examiner*—William C. Doerrler
(74) *Attorney, Agent, or Firm*—McAndrews, Held & Malloy, Ltd.

(57) ABSTRACT

In the present method, cold substances are transferred through a nozzle with moving parts. An insulating boot facilitates the method. The present method is generally suited for use in transferring cryogenic substances such as during the refueling of liquid natural gas vehicles. The present method causes an insulating layer to be created between a removable boot and a nozzle separating the ambient environment from the moving parts of the nozzle, purging the layer with a dry gas such as nitrogen to remove moisture and restricting the incursion of such moisture from the layer and therefore, from the moving parts to avoid freezing up of the moving parts. The layer can also help to avoid freezing up of the abutting interface created between the nozzle and receiving line when the nozzle is removably engaged to a receiving line.

25 Claims, 4 Drawing Sheets

METHOD FOR TRANSFERRING CRYOGENIC LIQUIDS AND ASSOCIATED CRYOGENIC FILL NOZZLE INSULATING BOOT

FIELD OF THE INVENTION

The present invention relates to a method of transferring cryogenic liquids and an associated removable insulating boot adaptable to a cryogenic nozzle.

BACKGROUND OF THE INVENTION

When handling liquids or gases at temperatures below an ambient or background temperature, special care should be taken to thermally insulate the ambient environment from the liquid or gaseous environment. Problems can arise from heat transfer between the liquid or gas environment through the containment material used to hold the liquid or gas. One such problem is that moisture within the ambient environment may be released from that environment and, if the temperature of the gas or liquid is low enough, that moisture may be frozen onto the surface of the containment material. Where moving parts are found within the containment material or where an interface exists between two detachable parts of the containment material, as is the case with nozzle attachments used to join lines for transferring liquid or gas between holding tanks, such parts can be difficult to move or detach, as the case may be, when moisture has frozen in and around those parts.

By way of example, such a problem arises where liquefied or cryogenic gases are being transferred between holding vessels. The ambient environment in this case is the surrounding air in which the transfer takes place. Generally, a nozzle will be used to connect lines leading between the holding tanks. Such a nozzle can include a coupling mechanism to connect onto a receiving line or conduit that, in turn, directs the liquefied gas into the holding tank. The coupling mechanism on the nozzle can include moving parts. Other moving parts can also be found on the nozzle such as flow controls and associated valves that regulate the movement of liquefied gas between holding tanks. During transfer of the cryogenic liquid through the nozzle, moisture found in the air surrounding and within the nozzle will freeze onto the surface of the nozzle as the nozzle is cooled well below the freezing point of the moisture. Equally, moisture that has seeped into the moving parts or abutting interfaces of the nozzle may freeze, thereby restricting movement of those moving parts. The moving parts in such a case may be "locked" frozen in position until the moisture is removed, melted, broken or otherwise dislodge from the surfaces in question.

As well, moisture frozen on the surface of the nozzle can melt between transfers and seep into the moving parts. This can create an accumulation of moisture on the surfaces of these parts over the course of several transfers. As more moisture accumulates, the time to melt the moisture and liberate the nozzle's moving parts can increase with subsequent fills.

As well, moisture can also seep into and between the mating surface or the "abutting interface" where the nozzle and receiving line meet. If this moisture then freezes on the surfaces that define this abutting interface and across the interface, it can be difficult to detach the nozzle from the receiving line. Ice accumulation may need to be broken or melted before the nozzle can be removed from the receiving line. For the purposes of this application, abutting interface will refer to areas between the nozzle and receiving line over which moisture can accumulate and freeze. An abutting interface seal is that part of abutting interface that provide any barrier between the ambient environment and the abutting interface.

For the purposes of this application, cryogenic temperatures are below −100° C.

One cryogenic operation that can experience the problems noted above arises when refueling natural gas powered vehicles that store their fuel in a liquefied form. Natural gas vehicles store fuel as either a compressed gas or liquefied gas chilled to cryogenic temperatures, known as liquefied natural gas (LNG). There are significant advantages to storing natural gas as a liquid over storage as a compressed gas. For example, an equivalent amount of gas can be stored as a liquid in a much smaller volume than is the case where the gas is stored under pressure. However, when refueling, liquid natural gas (LNG) must be transferred at very cold temperatures resulting in some of the problems noted above.

The majority of refueling nozzles used in refueling operations include moving parts as well as abutting interfaces between the nozzle and receiving line. As such, moisture from the air that freezes onto these surfaces must be dealt with between refueling operations.

These issues become more pressing as cryogenic storage of natural gas becomes more popular. More vehicles utilizing cryogenic natural gas will eventually result in the need to provide "assembly line" refueling operations. Already, fleet operations exist that benefit from an ability to fuel successive vehicles quickly. As such, freezing of moisture from the air onto any mechanical mating coupling can slow such refueling operations.

Currently, LNG refueling operators have a few options to deal with this problem. First, they can wait for the mating coupling and nozzle to warm allowing the moisture frozen around the coupling and interface with the receiving line to melt or re-evaporate before removing the nozzle for a subsequent refueling. Second, nitrogen, dry air or a similar dry gas or appropriate liquid can be used to clear moisture from around the nozzle's moving parts. Third, they can break the iced surfaces.

The first option requires a wait that can range between several minutes and several hours between consecutive refueling operations depending on the ambient conditions. The second option can be expensive as it requires significant volumes of gas or liquid, as the case may be, to effectively remove as much of the moisture from around the nozzle as possible so as to prevent further penetration of moisture into the nozzle occurs prior to or during subsequent refueling operations. Ideally, dry gas should be used throughout filling to ensure that moisture is inhibited from flowing into the moving parts. During filling, ice can accumulate on the surfaces of the nozzle and between consecutive fillings, some of that accumulated ice can melt and seep into the nozzle. Significant amounts of nitrogen are normally required to ensure that this does not happen. The third option causes stress to the moving parts and abutting interface. Over time these parts can be damaged prematurely and the interface can loose its seal and integrity. Alternatively, the parts can be engineered to mitigate the affect of stresses discussed, however, such design considerations can be expensive.

A fourth option for cold substance transfer generally is to use a de-icing solution. Most such solutions however, are ineffective at the temperatures used for LNG and other cryogens. For example, a de-icing solution such as ethylene glycol or propylene glycol is effective at temperatures to approximately −50° C.

Nozzle designs have also been developed with complicated integrated mechanisms wherein moving parts are insulated from moisture buildup. While these are workable, they are expensive solutions that require the replacement of industry-accepted nozzles and the associated fittings on the receiving line. Also, the insulating means around the moving parts in such nozzles are integrated into the nozzles. Therefore, the choices for insulating material can be limited. This material may need to be malleable at low temperatures to accommodate moving parts while also being durable as it can be difficult, expensive and time consuming to replace. In some cases, when this insulating material fails, it can be less time consuming and, therefore, more economical to replace the entire nozzle. Either way, the expense of this solution is significant.

The present technique provides an insulating boot to overcome the problems noted above. The present technique also provides a method of overcoming the above problems wherein a removable insulating boot is adapted to a nozzle prior to transfer of cryogenic liquids. As well, the present technique provides a method of insulating the abutting interface and moving parts including coupling mechanisms and flow control mechanisms while, at the same time, avoiding the problems noted above.

SUMMARY OF THE INVENTION

The present technique for transferring a cryogenic liquid and associated cryogenic fill nozzle insulating boot overcomes the problems noted above. The present method facilitates the transfer of cold liquid while preventing freezing of moving parts and interfaces created by such transfers. A boot effecting such transfer is an important feature of the present technique.

In the present method, a first substance transferred through a nozzle comprising at least one moving part and into a receiving line where the nozzle exists within an ambient environment and is removably engaged to a receiving line. The ambient environment comprises at least one constituent. The present method comprises introducing a second substance into the moving part or parts and a layer defined by a removable boot when that boot is adapted to the nozzle restrictively sealing the layer from the ambient environment. The layer is in communication with the moving part or parts. The method involves forcing the constituent or constituents from the moving part or parts by flowing the second substance through the layer. The constituent is then restricted from the moving part or parts by the layer created by the boot. This restriction is important when transferring the first substance through the nozzle and into the receiving line. The first substance is transferred at a temperature below the freezing temperature of the constituent or constituents within the ambient environment. It is also transferred at a temperature above the freezing temperature of the second substance.

In a further embodiment of the present method, the second substance is introduced into an abutting interface formed when the nozzle is engaged to the receiving line. The abutting interface is between the surface of the nozzle and receiving line that meet when removably engaged. The layer formed by the boot and nozzle is in communication with the abutting interface. The constituent(s) in the ambient environment are, again, forced from the abutting interface by the flow of the second substance noted above. As well, incursion of the constituent(s) are restricted from the abutting interface when the first substance is transferred through the nozzle into the receiving line.

A further embodiment of the present method includes restricting the incursion of the constituent(s) with an air tight seal on the boot that is engaged once substantially all of the constituent or constituents are forced from the moving part or parts, the layer created between the boot and the nozzle, and the abutting interface.

A further embodiment of the present method includes restricting incursion of the constituent(s) by maintaining a flow of the second substance through the moving part(s) and the layer and expelling the second substance from the layer through a restrictive seal on the boot.

A further embodiment of the present method includes restricting incursion of the constituent(s) by maintaining the flow of the second substance noted above, through the moving part or parts within the nozzle, the abutting interface and the layer formed between the boot and nozzle, and expelling the second substance from the layer through a restrictive seal on the boot.

In a further embodiment of the present method, the second substance is introduced through an access conduit disposed in the nozzle.

In a further embodiment of the present method, the boot is made from a material that comprises any one or more of neoprene, fluorosilicone, silicone, rubber, polyurethane and polytetrafluoroethylene (PTFE; trade name Teflon®).

In a further embodiment of the present method, a liquefied hydrocarbon is the first substance. The liquefied hydrocarbon can be liquid natural gas.

In a further embodiment of the present method, one of dry air, helium and nitrogen is the second substance. Water can also be a constituent of the ambient environment and the ambient environment can be atmospheric air.

In a further embodiment of the present method, the first substance is transferred at a cryogenic temperature.

In a further embodiment of the present method, a layer extends over the interface seal of the abutting interface. The interface seal is that part of the abutting interface that is directly exposed to the ambient environment where no boot is provided.

In a further preferred embodiment of the present method, the nozzle is a Parker™ 1169 nozzle.

A removable boot capable of fitting around a cryogenic nozzle comprises at least one moving part, wherein the boot and the nozzle define a layer restrictively sealed by the boot from an ambient environment. The layer is in communication with the moving part or parts. The boot is capable of restrictively sealing in a desiccating substance such as nitrogen, dry air and helium.

In a further embodiment of the boot, which is capable of restrictively sealing the layer from incursion of a constituent of the ambient environment, the constituent has a freezing temperature above cryogenic temperatures, namely, above −100° C. Such a constituent can be water.

The present boot can be made of neoprene, fluorosilicone, silicone, rubber, polyurethane and/or polytetrafluoroethylene (PTFE; trade name Teflon®). The present boot is preferably made from a material that is malleable at cryogenic temperatures and at the temperature of the ambient environment.

The boot is preferably adaptable to a Parker™ 1169 nozzle.

The present technique adapts an insulating material or removable boot that alone needs to be replaced when it fails, thereby reducing costs and downtime or repair and maintenance time while extending the available materials that can be used in such a boot.

Also downtime from breaking ice between surfaces is significantly reduced.

The solution also takes advantage of the nozzle designs that have gained market acceptance.

The present technique also provides an adaptable solution that does not require refitting or replacement of industry-accepted nozzles or the fittings associated with those nozzles.

Further, the present technique avoids situations in which insulating material used in the adapted prior art nozzles are the failure point for the whole nozzle.

DETAILED DESCRIPTION OF PREFERRED EMBODIMENT(S)

In the present method, a removable boot is adapted to a cryogenic nozzle used to transfer a quantity of LNG between holding tanks. The nozzle is then removably fitted to a receiving line connected to the tank to be filled. The nozzle is then purged of moisture within any moving parts of the nozzle as well as the abutting interface between the nozzle and the receiving line. This is done, generally, where a flow of a dry gas such as nitrogen is sent through an access line in the nozzle that leads to the interface and moving parts. The nitrogen then flows out of the nozzle into the layer between the nozzle and the boot. As the boot provides a restrictive seal around the nozzle, it will allow a small quantity of nitrogen, under pressure, to escape carrying any moisture out of the nozzle, from the abutting interface and from the layer. If dry gas flow is maintained, moisture will be restricted from entering into the layer. Once moisture is purged from the nozzle and abutting interface, LNG will be pumped through the nozzle into the receiving line as required.

The present technique includes a boot that is adaptable to a cryogenic nozzle to provide a space into which nitrogen can be pumped to ensure a layer around and within the nozzle that is substantially free of moisture during the transfer of LNG. That is, the boot should provide an environment free of moisture to a degree that any moisture remaining within and around the nozzle will not, if frozen to moving part surfaces or within the abutting interface, result in time delays following refueling or necessitate significant force to the moving parts or the interface that would, over time, reduce the life of the nozzle.

While the detailed description relates to a method and removable boot for use in an LNG refueling operation, it is applicable to systems wherein a quantity of one liquid or gas at a temperature lower than the temperature of the surrounding or ambient environment is transferred from holding facility to holding facility. Where there is a chance of a constituent within the ambient environment seeping into the interface between the transferring nozzle and receiving line or within the movable parts of the nozzle and freezing during the liquid or gas transfer, the present method and boot can be adapted to inhibit such incursion. Such liquid transfers include the transfer of liquid hydrocarbons other than LNG such as liquid methane and other cryogens such as liquid hydrogen, liquid nitrogen and liquid oxygen. Cold gaseous transfers can also benefit.

Figure 1:
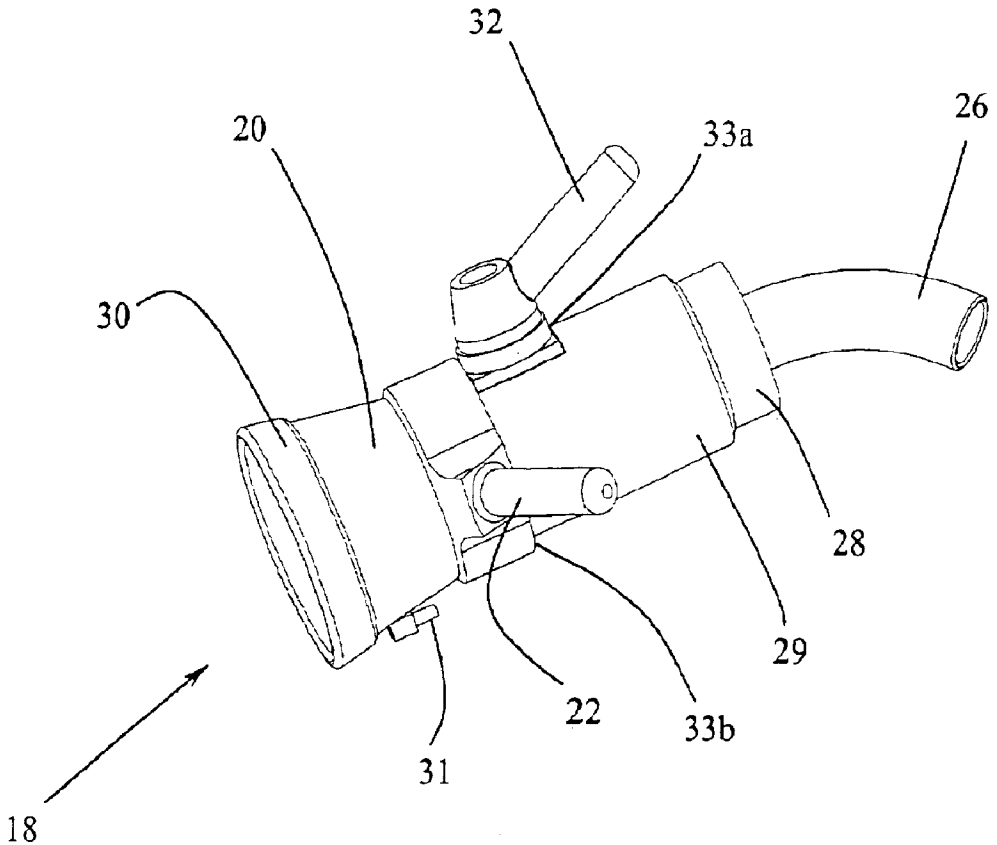
FIG. 1 (prior art)
FIG. 1 is a perspective view of a representative cryogenic refueling nozzle found within the industry.

Referring to FIG. 1, a figure of a typical industry standard nozzle 18 is provided. The nozzle shown is similar to a Parker™ 1169 liquid natural gas fuel nozzle. Mating mechanism 20 includes two grips 22 for manipulating/turning the mating mechanism. Delivery line 26 extends into base 28. Mating mechanism 20 expands out to splayed flange 30. Extending from body 29 is locking arm 32. Moving elements are found within this nozzle associated with locking arm 32 and mating mechanism 20. Each is exposed through leak paths 33*a* and 33*b*.

Access line 31 for delivering a stream of nitrogen is shown in mating mechanism 20. This line provides a path into the nozzle and around the mating surfaces and moving parts of the nozzle.

Figure 2A:
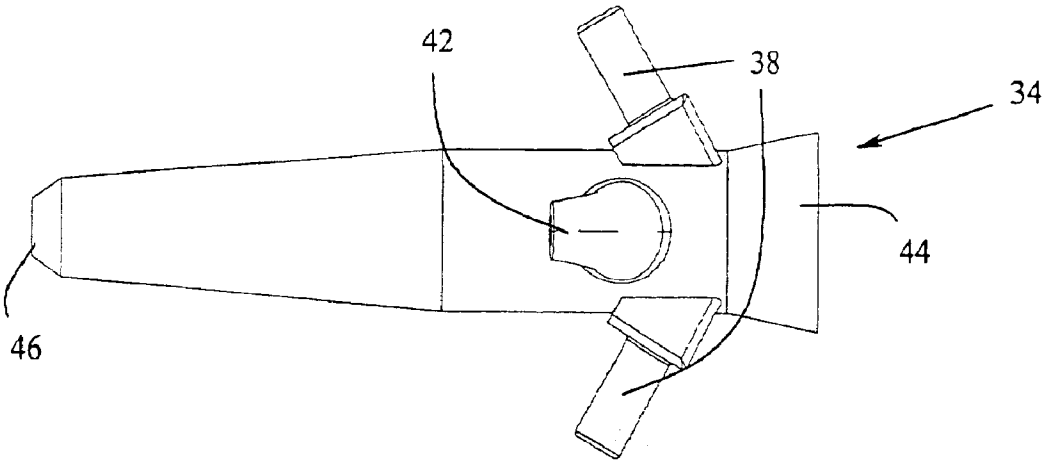
FIGS. 2*a* and 2*b* contain a top view, a side view and a bottom view of an insulating removable boot designed to be fitted over the cryogenic nozzle shown in FIG. 1.
Figure 2B:
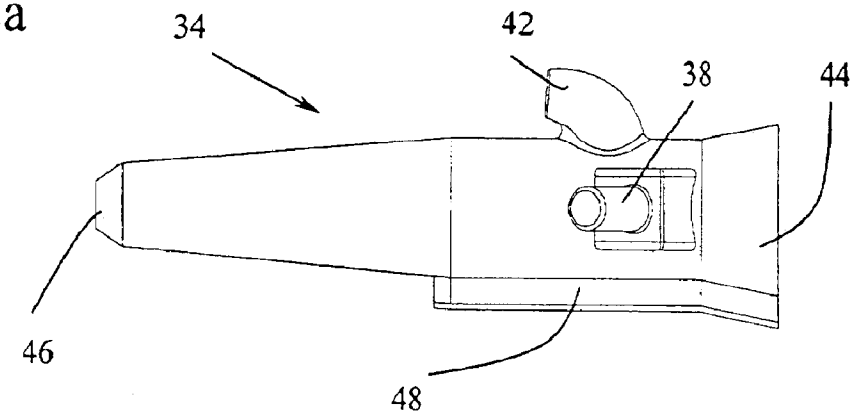

Referring to FIG. 2*a*, insulating boot 34 is shown. The boot is molded to malleably adapt to nozzle 18. The boot for nozzle 18 includes hollowed grip covers 38, locking arm seal 42, mating mechanism seal 44 and line seal 46. Referring to FIG. 2*b*, on the opposite side of locking arm seal 42 is fitting seam 48. In the embodiment shown, fitting seam 48 is sealed after boot 34 is positioned on nozzle 18. The seal can be provided by a hook-and-loop fastening (tradename Velcro™) strip, as is the case in the embodiment shown, or with a zipper mechanism or any other suitable sealing means. The seal need not be air tight as will be discussed below. It should only inhibit the movement of nitrogen through the seam once the seam is fitted on the boot. Fitting seam 48 preferably should be adapted to allow boot 34 to slip on and off of nozzle 18 as required.

Figure 3:
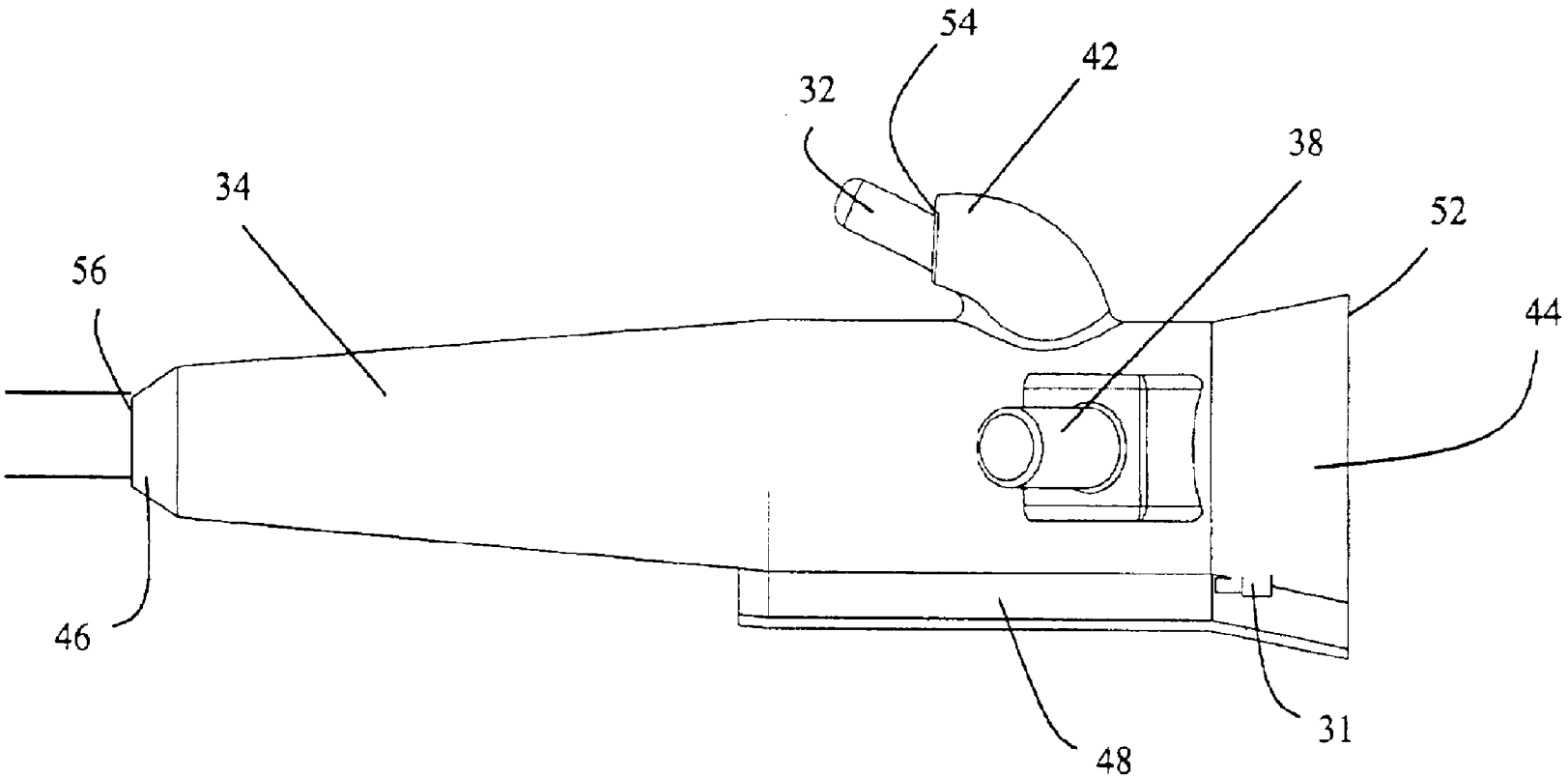
FIG. 3 is a side view of an insulating removable boot around the refueling nozzle shown in FIG. 1.

Referring to FIG. 3, boot 34 is fitted over nozzle 18 to define a layer between the boot and the nozzle, not shown. Once fitted, the boot provides three seal points 52, 54 and 56. Seam 48 also defines a seal point between the boot and the nozzle. Generally, seal point 52, 54 and 56 will be more air tight than seam 48 in order to better maintain control over the insulating layer between the boot and the nozzle, however, as will be discussed below, seal point 52, 54 and 56 and seam 48 can each provide varying degrees of sealing.

Figure 4:
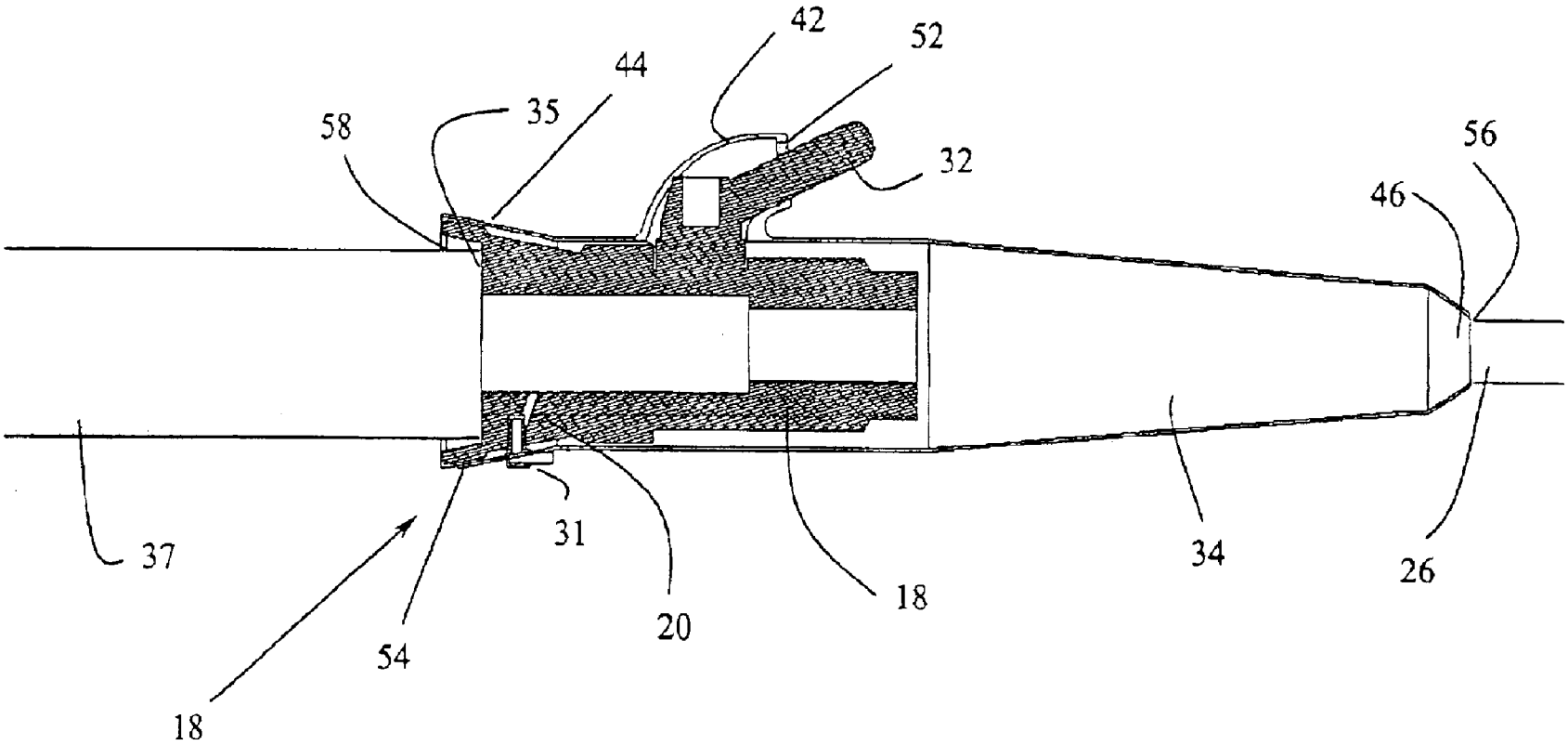
FIG. 4 is a simplified partial cross-sectional view of the refueling nozzle engaged to a receiving line demonstrating the abutting interface of the nozzle and receiving line. A removable boot is positioned on the nozzle.

Referring to FIG. 4, a partial cross-section of boot 34 fitted over nozzle 18 attached to a receiving line is shown. Abutting interface 35 between nozzle 18 and receiving line 37 is shown. This interface is defined in part by the mating surfaces of nozzle 18.

In the embodiment shown, and referring to FIGS. 1 and 4, access line 31 leads to abutting interface 35 and through the internal parts of nozzle 18 through leak paths 33*a* and 33*b*. Abutting interface seal 58 is also shown.

Referring to FIGS. 1 through 4, prior to transfer of any cold substances such as LNG between holding tanks, nozzle 18 can be removed from delivery line 26. Fitting seam 48 is opened, in the embodiment shown, by pulling the hook-and-loop fastener (Velcro™) fitting seal open. The seam should be long enough to allow the boot to pull over the nozzle from the delivery line end through to splayed flange 30. Boot 34 is restricted, in this regard, by the radius of the grips and radius of the locking arm measured from nozzle body 29. As such the seam length will be determined in part by these radii. This seam length will also be dependant to some extent on the malleability of the boot. That is, boot 34, if made from a very malleable material, can be easily stretched over grips 22 and arm 32 with a relatively small seam length. Note, however, that malleability should be balance against the degree of seal at seal point 52, 54 and 56.

Once boot 34 is pulled to position, locking arm seal 42 and grip covers 38 are slipped over locking arm 32 and grips 22, respectively. Boot 34, at mating mechanism seal 44, is pulled up over mating mechanism 20. Once seals 42, 44 and 46 are positioned, seam 48 is closed. Seal 42 is positioned at the base of locking arm 32 to create seal point 52, seal 44 is positioned over mating mechanism 20 to create seal point 54 and seal 46 is positioned over or near base 28 to create seal point 56. A layer between mating mechanism 20, interface 28 and locking arm 32 is restrictively sealed between boot 34 and nozzle 18. Leak paths 33*a* and 33*b* exit out into the layer and, as such, are isolated from direct communication with the ambient environment outside of the boot. Nozzle 18 is then reattached to delivery line 26.

Nitrogen line 31 should be accessible when the boot is positioned as shown in FIGS. 3 and 4.

Referring to FIGS. 3 and 4, with boot 34 fitted on nozzle 18, it is important that three seal points 52, 54 and 56 of the boot be well molded to adapt to the surfaces of the nozzle.

Once the boot is positioned on the nozzle, the nozzle is then secured to a receiving line through a fitting on the receiving line by adjusting mating mechanism 20 and locking arm 32 to the receiving line thereby engaging nozzle 18 to the receiving line creating a flow path through the nozzle to the receiving line. Abutting interface 35 is formed across the surfaces at which nozzle 18 and receiving line 37 are removably engaged: see FIG. 4.

When secured, the layer provided between the boot and the nozzle is cleared of air and moisture by forcing a stream of nitrogen through access line 31, past abutting interface 35 and through nozzle 18, out through leak path 33*a* and 33*b* into the layer between the boot and the nozzle. Circulating through the nozzle, the nitrogen forces moisture from abutting interface 31 and the moving parts of the nozzle out leak paths 33*a* and 33*b* into the layer between the boot and the nozzle and out through seam 48. Preferably, the seal point 52, 54 and 56 should be relatively air-tight while seam 48 should restrict air movement over the pressure ranges chosen for the nitrogen purge. This allows flow through access line 31 to be controlled more effectively as there is one passage out of the layer between the boot and the nozzle. However, nitrogen flow can exit at seal points 52, 54 and 56. Some nitrogen may, in the embodiment shown, also escape at abutting interface seal 58 between the receiving line and nozzle.

Nitrogen flow is kept relatively low in the present technique. The boot 34 forces moisture and air from the nozzle and the layer between the boot and the nozzle through seam 48. Therefore, it is advantageous to allow a restrictive flow from the boot.

Once the layer of nitrogen is in place between the boot and the nozzle and the layer, interface 35 and moving parts are substantially free of moisture, the nozzle is ready to transfer LNG. Flow of cryogenic fluid, once started, passes through nozzle 18 to receiving line 37 through a fitting on that line that joins nozzle 18 to receiving line 37.

Nitrogen flow is maintained during the fill to ensure the integrity of the nitrogen layer between the boot and the nozzle and inhibit moisture incursion back through seam 48 into the layer once moisture has been purged. The flow rate should be low in light of the restrictive flow past seam 48, thus conserving nitrogen consumption. Also, if there is leakage past interface seal 58, nitrogen flow will help to inhibit moisture incursion here.

During a fill, moisture in the air can freeze onto the outer surface of the boot creating an ice build-up. However, upon completion of filling, little if any moisture will have incurred into the moving parts of the nozzle or the abutting interface due to the continued limited flow of nitrogen. As such, the moving parts should move freely prior to and following successive refueling operations. Also abutting interface 35 should not accumulate ice causing the nozzle to freeze to the receiving line. The nozzle should be easily extracted from the receiving line regardless of the temperature of this interface. The nozzle is therefore available for consecutive refueling operations.

Preferably, the selection of material for the boot should be made to allow the boot to move with some flexibility following and during a filling. At temperatures below −100 C, the boot should maintain malleability allowing the mating mechanism and locking arm to move easily while the boot is in place around the nozzle. Also, the boot should to be malleable when at ambient temperatures so as to allow the boot to be easily pulled on and off over the nozzle. By way of example, neoprene, fluorosilicone, silicone, rubber, polyurethane and polytetrafluoroethylene (tradename Teflon®) are appropriate materials. Composites that include glass fiber, polyimide fiber (tradename Kevlar™) and graphite are also appropriate.

The thickness of the boot is a consideration. As will be apparent to persons skilled in the technology involved here, highly malleable material at ambient temperatures can be made relatively thick as it can be easily pulled onto the nozzle. This provides advantages as the thickness of the boot helps extend the life of the boot. Regardless of the material used, however, the boot will generally be more brittle at lower temperatures. Wear on the boot at such temperatures can cause the boot to eventually crack or tear, dictating the life of the boot. A thicker boot will generally take longer to crack or tear to the point of failure thereby increasing the longevity of the boot over a thinner boot. The main consideration is that a thicker boot is relatively less malleable than an equivalent thinner boot and more expensive. Such a boot is therefore more difficult to pull onto the nozzle prior to filling. As is apparent to a person skilled in the technology involved here, a balance should be struck between malleability, durability and longevity. There are advantages to being able to pull the boot on and off easily, however, frequent replacement of the boot increases costs and the time required for a given refueling operation as extra time is needed to replace boots more frequently. Also, as noted above, malleability has an impact on the quality of seal points 52, 54 and 56.

As noted above, while nitrogen is discussed as the desiccating media, other gases, such as helium, argon, dry air (from compressor with $H_2O$ removed) or even liquids, such as appropriate hydrocarbons, can provide a means of evacuating moisture from within and around the nozzle. What is important is that the substance chosen:

(1) have a freezing temperature lower than the temperature of the transferred liquid, and (2) that the gas or liquid be able to access moving parts within nozzle 18 and interface 35 forcing moisture from these areas of the nozzle.

In an alternate embodiment of the present technique, boot 34 can be designed so that it can be pulled over nozzle 18 and back to or beyond base 28, towards delivery line 26. In such an embodiment, not shown, the seam would extend back to the base of the boot through line seal 46 to allow the boot to pull over grips 22 and locking arm 32. Once pulled back over the nozzle, the boot could then be brought forward over the nozzle as described in regards to the embodiment noted above. The advantage of this embodiment is that it avoids having to remove nozzle 18 from delivery line 26. However, in general, this embodiment of the boot will, in general, require a longer seam length. This will, in turn, reduce the control of leakage through seam 48.

A further alternate embodiment of the boot could utilize a fully enclosed seam that can be used to pull over locking arm 32 sealing off locking arm 32.

A further embodiment of the boot and the method allows an initial purge of nitrogen to escape seal 48 forcing moisture out from the nozzle and the layer between the boot and the nozzle. Once a suitable period has elapsed for flow through seal 48 substantially removing moisture from the interface, nozzle and layer, the seal can then be more tightly sealed restricting most if not all nitrogen from escaping the layer thus enabling a reduced nitrogen flow while maintaining the nitrogen pocket in the layer and preventing moisture incursion into the nozzle.

For the purposes of this application, a restrictive seal will allow a adequate flow of nitrogen to expel moisture from the layer between the nozzle and boot after that moisture has been forced from moving parts in the nozzle and from around the interface. The restrictive seal should then prevent excess flow of nitrogen out of the layer while, at the same time, preventing the incursion of moisture.

An alternate embodiment of the present method includes an embodiment where boot 34 is pulled over interface seal 58 once the nozzle and receiving line are engaged. This provides a layer over seal 58 that further helps to prevent incursion of moisture through seal 58. While this embodiment provides greater insulation to abutting interface 35, it requires, at the least, extra time to pull the boot over the receiving line before each fill. Extra time may also be required to retract the boot following each fill. Also, moving parts within the nozzle between consecutive fills should remain relatively moisture free while the nitrogen purge continues. However, if the layer is being exposed between fills by the removal of the boot from seal 58, the relatively moisture free layer can be lost, exposing the moving parts to moisture between fills. Therefore, the advantage of extending the boot over seal 58 can be limited by the fact that the nitrogen insulation layer can be lost between each fill.

This method of pulling the boot over the seal 58 can have advantages when a nozzle is used that does not include moving parts.

While the description considers a nozzle similar in design to the Parker™ 1169 nozzle, other nozzles used to transfer cold and cryogenic liquids or gases can be adapted to take advantage of the present technique. By way of example, one such nozzle is the Moog 50E721 LNG nozzle. As would be apparent to a person skilled in the technology involved here, the boot should be adapted to provide an insulated layer that would help to prevent incursion of moisture into the moving parts of the nozzle in question and direct moisture from within and around the nozzle.

While particular elements, embodiments and applications of the present invention have been shown and described, it will be understood, of course, that the invention is not limited thereto since modifications may be made by those skilled in the art without departing from the scope of the present disclosure, particularly in light of the foregoing teachings.

What is claimed is:

1. A method of transferring a first substance through a nozzle comprising at least one moving part into a receiving line, said nozzle within an ambient environment and removable from said receiving line, said ambient environment comprising at least one constituent, said method comprising:

introducing a second substance into said at least one moving part and a layer defined by a removable boot when said boot is adapted to said nozzle restrictively scaling said layer from said ambient environment, said layer in communication with said at least one moving part, said boot made from a malleable material capable of accommodating removal and replacement of said boot from said nozzle at ambient temperatures;

forcing said at least one constituent from said at least one moving part and said layer with a flow of said second substance;

restricting incursion of said at least one constituent from said at least one moving part and said layer when transferring said first substance through said nozzle into said receiving line, wherein said first substance is transferred at a temperature below the freezing temperature of said at least one constituent and above the freezing temperature of said second substance;

introducing said second substance into an abutting interface defined when said nozzle is engaged to said receiving line, wherein said layer is in communication with said abutting interface;

forcing said at least one constituent from said abutting interface with said flow of said second substance; and restricting incursion of said at least one constituent from said abutting interface when transferring said first substance through said nozzle into said receiving line.

2. The method of claim 1 wherein restricting incursion of said at least one constituent is provided by an air tight seal on said boot that is engaged once substantially all of said at least one constituent is forced from said at least one moving part, said abutting interface and said layer.

3. The method of claim 1 wherein restricting incursion of said at least one constituent is provided by maintaining said flow of said second substance through said at least one moving part and said layer and expelling said second substance from said layer through a restrictive seal on said boot.

4. The method of claim 1 wherein restricting incursion of said at least one constituent is provided by maintaining said flow of said second substance through said at least one moving part, said abutting interface and said layer, and expelling said second substance from said layer through a restrictive seal on said boot.

5. The method of claim 4 wherein said second substance is introduced through an access conduit disposed in said nozzle.

6. The method of claim 1 wherein said boot is made from a material comprising at least one of neoprene, fluorosilicone, silicone, rubber and polyurethane.

7. The method of claim 1 wherein said first substance is a liquefied hydrocarbon.

8. The method of claim 7 wherein said first substance is liquid natural gas.

9. The method of claim 1 wherein said second substance is one of nitrogen gas, helium gas and dry air.

10. The method of claim 1 wherein said at least one constituent is water.

11. The method of claim 1 wherein said ambient environment is atmospheric air.

12. The method of claim 1 wherein said first substance is transferred at a cryogenic temperature.

13. The method of claim 1 wherein said layer extends over the interface seal of said abutting interface.

14. The method of claim 1 wherein said nozzle comprises a mating mechanism having two grips for guiding said mechanism said mating mechanism expanding to a splayed flange, a locking arm, and a nitrogen gas access line.

15. A removable boot capable of fitting around a cryogenic nozzle that has at least one moving part, said boot comprising an air impermeable membrane which defines about said nozzle a moisture insulating layer which is restrictively sealed by said membrane and said nozzle from an ambient environment, said moisture insulating layer being in communication with said at least one moving part, said boot made from a malleable material capable of accommodating removal and replacement of said boot from said nozzle at ambient temperatures, said boot comprising a resealable member that enables the boot to be fitted over the nozzle.

16. The boot of claim 15 wherein said boot is capable of restrictively sealing a desiccating substance.

17. The boot of claim 16 wherein said desiccating substance is at least one of nitrogen, dry air and helium in said layer.

18. The boot of claim 15 wherein said boot is capable of restrictively sealing said layer from incursion of a constituent of said ambient environment, said constituent having a freezing temperature above cryogenic temperatures.

19. The boot of claim 18 wherein said constituent is water.

20. The boot of claim 15 wherein said boot is made from at least one of neoprene, fluorosilicone, silicone, rubber and polyurethane.

21. The boot of claim 15 wherein said boot is made from a material that is malleable at cryogenic temperatures and at the temperature of the ambient environment.

22. The boot of claim 15 wherein said cryogenic nozzle comprises a mating mechanism having two grips for guiding said mechanism said matting mechanism expanding to a splayed flange, a locking arm, and a nitrogen gas access line.

23. The boot of claim 15 wherein the boot provides at least one restrictive seal point about the nozzle and the resealable member provides a second restrictive seal point that is less restrictive than the seal points.

24. The method of claim 1 wherein said boot is made from a material comprising polytetrafluoroethylene.

25. The boot of claim 15 wherein said boot is made from a material comprising polytetrafluoroethylene.

* * * * *

UNITED STATES PATENT AND TRADEMARK OFFICE

CERTIFICATE OF CORRECTION

PATENT NO. : 6,923,008 B2 
DATED : August 2, 2005
INVENTOR(S) : Thomas Currie Brook and Samuel Douglas Chambers It is certified that error appears in the above-identified patent and that said Letters Patent is hereby corrected as shown below:

Title page,
Item [73], Assignees, please delete "Westpoint Research Inc." and insert -- Westport Research Inc. --.

Column 10,
Line 10, delete "scaling;" and substitute -- sealing --.

Signed and Sealed this

Thirteenth Day of December, 2005

JON W. DUDAS
*Director of the United States Patent and Trademark Office*